US005285850A

United States Patent [19]

Bayh, III

[11] Patent Number: 5,285,850

[45] Date of Patent: Feb. 15, 1994

[54] WELL COMPLETION SYSTEM FOR OIL AND GAS WELLS

[75] Inventor: Russell I. Bayh, III, Carrollton, Tex.

[73] Assignee: Halliburton Company, Houston, Tex.

[21] Appl. No.: 775,287

[22] Filed: Oct. 11, 1991

[51] Int. Cl.[5] ..... E21B 34/10

[52] U.S. Cl. ..... 166/321; 166/77; 166/240; 166/322; 166/386

[58] Field of Search ..... 166/322, 321, 384, 385, 166/375, 380, 77, 386, 242, 240

[56] References Cited

U.S. PATENT DOCUMENTS

| | | | |
|---|---|---|---|
| 3,051,243 | 8/1962 | Grimmer et al. | 166/332 |
| 3,208,531 | 9/1965 | Tamplen | 166/125 |
| 4,321,965 | 3/1982 | Restarick et al. | 166/117.5 |
| 4,619,323 | 10/1986 | Gidley | 166/242 X |
| 4,625,798 | 12/1986 | Bayh, III | 166/106 |
| 4,625,799 | 12/1986 | McCormick et al. | 166/240 X |
| 4,749,341 | 6/1988 | Bayh, III | 417/360 |
| 4,844,166 | 7/1989 | Going, III et al. | 166/379 |
| 4,921,044 | 5/1990 | Cooksey | 166/242 X |
| 4,923,012 | 5/1990 | Hopmann | 166/385 |
| 4,928,772 | 5/1990 | Hopmann | 166/386 |
| 4,986,362 | 1/1991 | Pleasants | 166/382 |
| 5,012,871 | 5/1991 | Pleasants | 166/386 |
| 5,090,481 | 2/1992 | Pleasants et al. | 166/384 X |
| 5,146,984 | 9/1992 | Pleasants | 166/238 |
| 5,156,206 | 10/1992 | Cox | 166/242 |

*Primary Examiner*—Hoang C. Dang

*Attorney, Agent, or Firm*—Tracy W. Druce; Warren B. Kice

[57] ABSTRACT

A well completion system and method in which reeled tubing is connected in the completion string which includes a safety valve and a sliding sleeve valve. A straddle assembly is provided within the sliding sleeve valve for sealing against axial flow of fluid and isolating a lateral fluid flow path. A stinger assembly is provided which is insertable within the straddle assembly and connectable to the reeled tubing to lock the reeled tubing relative to the straddle assembly and the sleeve valve. The sliding sleeve valve functions to selectively control the lateral flow of production fluid into the production string for upward flow through the safety valve and the reeled tubing to the ground surface.

17 Claims, 6 Drawing Sheets

WELL COMPLETION SYSTEM FOR OIL AND GAS WELLS

BACKGROUND OF THE INVENTION

The present invention relates to a well completion system and method for recovering production fluid, such as oil, from an oil or gas well, and, more particularly, to such a system and method utilizing reeled tubing for controlling the flow of the production fluid from the well.

In the operation of subterranean oil and gas earth wells, various types of equipment have evolved for controlling the flow of production fluid to the ground surface. This equipment is usually connected in, or to, a string of production tubing formed by a plurality of tubing sections.

Reeled tubing i.e. continuous, relatively thin-walled, bendable tubing, is becoming more and more popular in downhole servicing of oil and gas wells since it has many advantages when compared to wireline or connected tubing sections. For example, reeled tubing can be more rapidly inserted into the well and can be more easily passed through downhole equipment. Also, the reeled tubing can traverse highly deviated, or horizontal, wells which could otherwise not be traversed with wireline or threaded tubing in a controlled manner.

Although reeled tubing would be ideally suited for well completion systems since it would enjoy the above advantages and, in addition, eliminate the multiple joints between the production tubing sections, reeled tubing has not enjoyed widespread use in this manner for several reasons. For example, its relatively thin walls preclude threading for attaching the tubing to completion equipment such as pumps, landing nipples, safety values, well hangers, etc. Also, there has been no known effective use of reeled tubing for conveying production fluid from the formation to ground surface due to the need for relatively sophisticated high pressure sealing and blow-out prevention techniques. Further, many connections of the various components making up a well completion system require relative rotation between the various components. For example, when a section of tubing is attached to a well completion tool, matching threads are formed on the tool and the tubing, or to a sub attached to the tubing, so that the connection can be made by advancing and rotating one of the components relative to the other. However, these type of connections have stress limitations that are well below the stress limitations of a continuous section of reeled tubing. Also, these type of connections are inadequate when the reeled tubing is connected to downhole tools having a rotary component such as electrical submersible well pumps which are often used in well completion systems to pump production fluid from a formation, into and through a casing string and a production tubing string, and to a wellhead above surface.

Another reason that reeled tubing has not enjoyed widespread use in well completion systems is that emergency release devices are often used to connect the reeled tubing to certain operating tools for providing a quick and reliable disconnect during emergency conditions, such as, for example, when the operating tool is jammed in the well. (An emergency release device of this type is disclosed in U.S. Pat. No. 4,986,362 assigned to the assignee of the present invention.) However, if reeled tubing is used in a well completion environment with tools having a rotary component, the emergency release device discussed above does not lock against rotation of the operating tool relative to the reeled tubing. Therefore, if the rotating component of the tool becomes jammed, one component of the emergency release device would rotate, or free-wheel, relative to the other. This makes it difficult to free the jammed rotary tool.

Another potential disadvantage of reeled tubing in this context is that, in well completion systems a safety valve is usually deployed in the well completion string for blocking the flow of production fluid to the ground surface under emergency conditions. However, if reeled tubing is used in the string and the safety valve is activated to shut off, reactive forces are created which would tend to bend the reeled tubing and cause leakage of the production fluid.

SUMMARY OF THE INVENTION

It is therefore an object of the present invention to provide a well completion system and method utilizing reeled tubing.

It is a still further object of the present invention to provide a well completion system and method of the above type in which production fluid passes uphole through the completion string, including the reeled tubing and a safety valve, to the ground surface.

It is a further object of the present invention to provide a system and method of the above type in which the flow of the production fluid from the well formation to the production string is selectively controlled.

It is a further object of the present invention to provide a system and method of the above type in which the flow of the production fluid through the production string is selectively controlled.

It is a further object of the present invention to provide a system and method of the above type in which the reeled tubing can be connected to downhole well completion tools without stressing o damaging the tubing.

It is still further object of the present invention to provide a system and method of the above type in which sealing and blow out prevention is achieved.

It is further object of the present invention to provide a system and method of the above type in which the reeled tubing can be connected to a tool having a rotary component.

It is a further object of the present invention to provide a system and method of the above type in which the various components of the production string ca be easily an quickly disconnected.

Toward the fulfillment of these and other objects, according to the well completion system and method of the present invention reeled tubing is connected in the completion string which includes a safety valve and a sliding sleeve valve. A straddle assembly is provided within the sliding sleeve valve for sealing against axial flow of fluid and isolating a lateral fluid flow path. A stinger assembly is provided which is insertable within the straddle assembly and connectable to the reeled tubing to lock the reeled tubing relative to the straddle assembly and the sleeve valve. The sliding sleeve valve functions to selectively control the lateral flow of production fluid into the production string for upward flow through the safety valve and the reeled tubing to the ground surface.

The system includes a connector for connecting the reeled tubing to the completion string in a manner to transfer axial and torsional loads from the string to the reeled tubing. Also the system includes a connecting device which connects between the reeled tubing and the production string in a manner to prevent both axial and rotational movement therebetween yet permit quick release of the reeled tubing during emergency conditions.

DESCRIPTION OF THE DRAWINGS

The above brief description, as well as further objects, features and advantages of the present invention will be more fully appreciated by reference to the following detailed description of the presently preferred but nonetheless illustrative embodiments in accordance with the present invention when taken in conjunction with the accompanying drawings wherein.

DESCRIPTION OF THE PREFERRED EMBODIMENT

Figure 1:
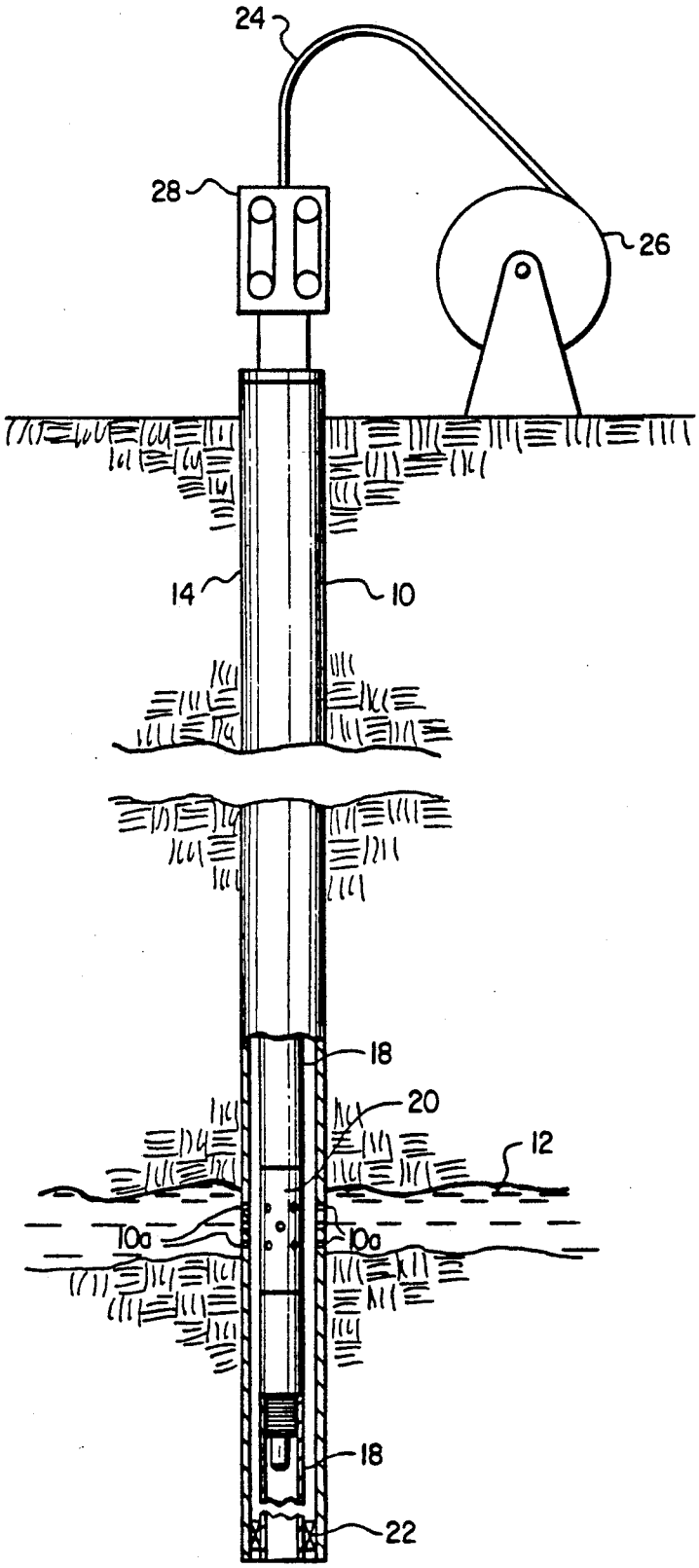
FIG. 1 is a schematic view, partially in elevation and section, and partially broken away, of an oil or gas well, showing the system of the present invention installed in a wellbore casing.

Referring to FIG. 1 of the drawings, the reference numeral 10 refers to a casing passing through a formation 12 in an oil or gas well 14. The well completion system of the present invention includes a string of well tubing 18 in a coaxial relationship with the casing 10 and a sliding sleeve valve assembly 20 connected between two sections of the tubing. The valve assembly 20 is positioned in the casing 10 so that a series of perforations (to be described) provided through the valve assembly are in alignment with a plurality of perforations 10*a* in the casing 10. This permits production fluid to flow from the formation 12, into the annulus between the casing 10 and the tubing string 18 and then into the valve assembly 20, as will be described. A packer 22 extends between the tubing string 18 and the casing 10 below the valve assembly 20 to isolate the formation 12 from the lower portion of the well 14.

A section of reeled tubing 24 is stored on a reel 26 above ground and is injected into the casing 10 by an injector 28. The reeled tubing 24 is preferably fabricated from soft-sheet steel which is rolled and induction welded along its length before being spooled onto the reel 26. The tubing is then heat-treated on the reel to stress-relieve the tubing wall and the seam weld. Several sections of the tubing are then butt-welded together to achieve lengths of up to several thousand feet.

It is understood that a manifold (not shown) is provided which includes the necessary pumps, valves, and fluid reservoirs to discharge a fluid into and through the reeled tubing 24. It is also understood that a wellhead valve (not shown) can be used to control vertical access to, and fluid communication with, the upper portion of the well tubing, and blowout preventers, or the like (not shown), can be installed to block fluid flow during emergency conditions. Since these components are conventional they will not be described in any further detail.

Figure 2A:
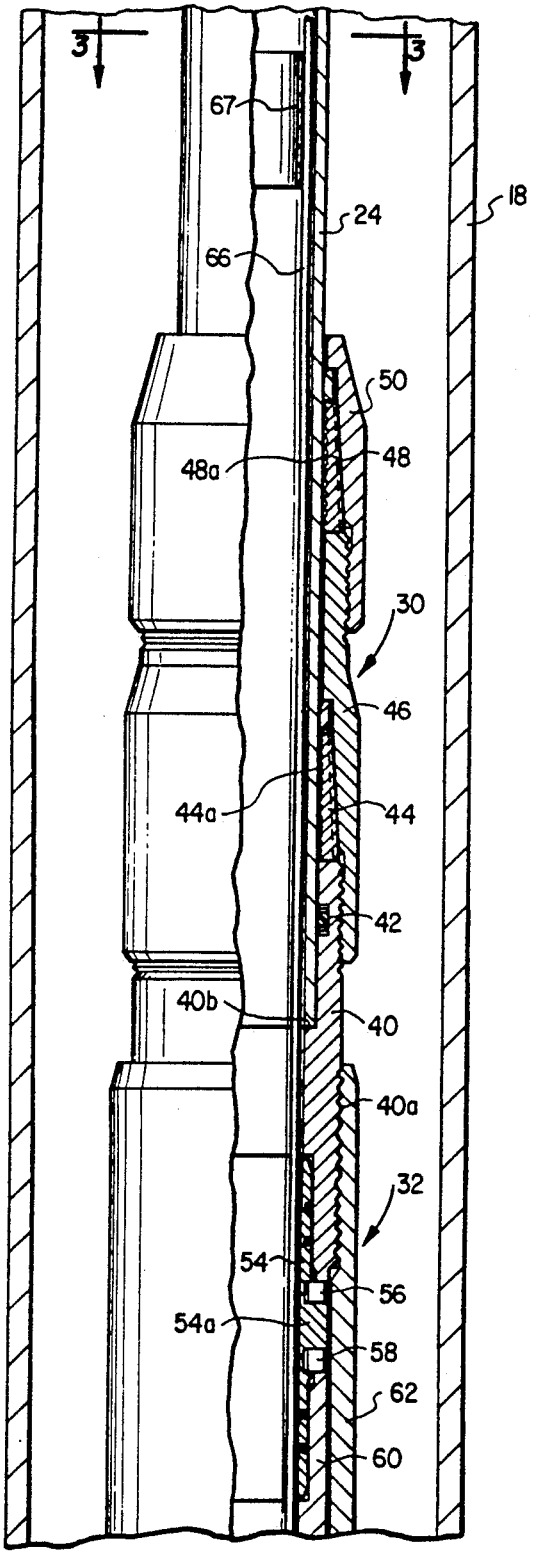
FIGS. 2A-2G are enlarged longitudinal sectional views of the system of the present invention with FIG. 2B being a downward continuation of FIG. 2A, FIG. 2C being a downward continuation of FIG. 2B, FIG. 2D being a downward continuation of FIG. 2C, FIG. 2E being a downward continuation of FIG. 2D, FIG. 2F being a downward continuation of FIG. 2E and FIG. 2G being a downward continuation of FIG. 2F.

The reeled tubing 24 extends into the well tubing 18 and is connected to a string of components disposed within the well tubing 18 as shown in detail in FIGS. 2A-2G. More particularly a connector 30 (FIG. 2A) is provided which connects the leading end portion of the reeled tubing 24 to an indexing union assembly 32. The connector 30 includes an end sub 40 having a lower end portion, as viewed in FIG. 2A, provided with external threads 40*a* to receive a corresponding internally threaded sub (to be described) of the indexing union assembly 32. An annular flange is formed on the inner surface of the sub 40 to define a shoulder 40*b*. The connector 30 receives the reeled tubing 24 with the corresponding end of the reeled tubing 24 abutting against the shoulder 40*b* which thus functions as a load-bearing surface. An annular groove is formed in the inner surface of the sub 40 which receives an elastomeric seal ring 42 for engaging a corresponding portion of the outer wall of the reeled tubing 24.

The outer surface of the upper end portion of the sub 40 is tapered inwardly and a plurality of angularly-spaced windows are formed through the latter tapered sleeve portion which respectively receive and support a corresponding number of locking slips 44. Although not shown in the drawings it is understood that, according to a preferred embodiment, seven windows are angularly spaced around the tapered end portion of the sleeve 40 which receive a corresponding number of locking slips 44. The outer surfaces of the slips 44 are tapered in a manner to compliment the taper of the upper end portion of the sub 40, and the inner surfaces of the slips are provided with teeth 44*a* which engage the outer surface of the reeled tubing 24 in the connected position shown. The portion of the sub 40 through which the windows extend define flat surfaces against which the corresponding surface of the slips 44 can abutt, thus positively retaining the slips in the windows.

A portion of an intermediate coupling sleeve 46 extends over the sub 40 and includes an internally threaded lower end portion which is in threaded engagement with the threaded intermediate portion of the sub 40. The sleeve 46 has an intermediate portion the bore of which has a taper that corresponds to the taper of the slips 44 and the tapered upper end portion of the sub 40. Thus, as the sleeve 46 is rotated and advanced downwardly, as viewed in FIG. 2*a*, over the sub 40, the tapered bore of the sleeve 46 engages the slips 44 and cams, or forces, them into locking engagement with the corresponding outer wall portion of the reeled tubing 24.

The outer surface of the upper end portion of the sleeve 46 is tapered inwardly as shown, and a plurality of angularly-spaced windows, similar to the above-described windows of the sub 40, are formed therethrough for receiving a plurality of locking slips 48 which are similar to the slips 44. Thus, the slips 48 are tapered in a manner to compliment the taper of the tapered upper end portion, and the inner surfaces of the slips 48 are provided with teeth 48*a* which lockingly engage the corresponding outer surface of the reeled tubing 24.

An outer surface of an intermediate portion of the sleeve 46 is threaded to receive an internally threaded lower end portion of an end cap, or sub, 50. The bore of an intermediate portion of the sub 50 is tapered in a manner to compliment the slips 48 and the tapered end portion of the sleeve 46. Thus, as the end sub 50 is rotated and advanced downwardly, as viewed in FIG. 2*a*, over the sleeve 46, the tapered bore of the sub 50 engages the slips 48 and forces them into locking engagement with the outer surface of the reeled tubing 24.

In the event an even greater torsional coupling is desired, one or more additional coupling sleeves, which would be identical to the coupling sleeve 46, could be installed between the sleeve 46 and the end sub 50, and each additional sleeve would have a set of slips for engaging the reeled tubing. Further details of the connector 30 are described in U.S. Pat. No. 5,156,206 assigned to the assignee of the present invention, the disclosure of which is hereby incorporated by reference.

It thus can be appreciated that, as a result of the foregoing arrangement, the subs 40 and 50 together with the sleeve 46 form a mandrel for receiving the reeled tubing 24 which is positively locked against any axial and rotational movement. Also, the reeled tubing 24 can support components to be described which produce tensile stresses up to the tensile stress limits of the reeled tubing.

The indexing union assembly 32 includes an inner sleeve 54 having a centrally radially extending inner flange 54*a*. A plurality of pins 56 are press fitted into corresponding sockets bored into the upper portion of the flange 54*a*, with the upper portion of each pin extending in recesses (not shown) formed in the lower end of the sub 40 of the connector 30. In a similar manner, a plurality of pins 58 are pressed fitted into corresponding sockets bored in the lower portion of the flange 54*a* with the upper portion of each of the latter pins extending in recesses (not shown) formed in the upper end of a connector sleeve 60 extending coaxially with the sub 40 and the inner sleeve 54.

An outer sleeve 62 extends over the lower end portion of the sub 40, the sleeve 54 and the upper end portion of the sleeve 60. The bore of the outer sleeve 62 is stepped to define a shoulder 62*a* (FIG. 2B) against which an outer flange 60*a* of the sleeve 60 abutts. The upper end portion of the sleeve 62 is internally threaded and in engagement with an externally threaded lower end portion of the sub 40. A lock nut 64 (FIG. 2B) is threaded over an externally threaded portion of the sleeve 60 and abutts the lower end of the sleeve 62 to lock the assembly in place. The indexing union assembly 32 is described in detail in U.S. Pat. No. 4,749,341, assigned to the assignee of the present invention, the disclosure which is incorporated by reference.

Figure 2C:
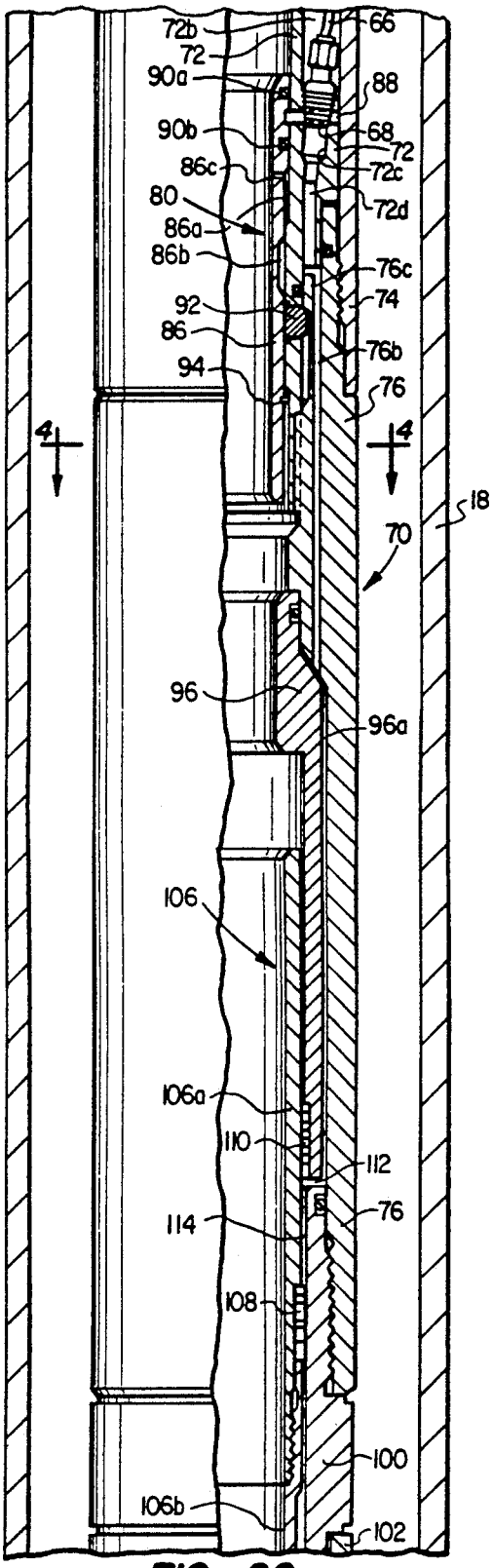
Figure 3:
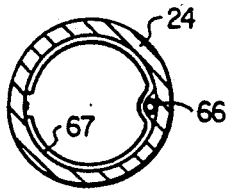
FIGS. 3 and 4 are enlarged sectional views taken along the lines 3—3 and 4—4 of FIGS. 2A and 2C, respectively.

Referring to FIGS. 2A and 3, a hydraulic fluid control line 66 extends from above surface inside the reeled tubing 24 and continues through the bore defined by the connector 30 and the indexing union assembly 32. A series of clips 67 (one of which is shown) are provided at spaced intervals along the reeled tubing and the latter bore to support the line 66 against their respective inner walls. A fitting 68 (FIG. 2*c*) is affixed to the end of the line 66. The purpose of the fitting 68 and the control line 66 will be described later.

Figure 2B:
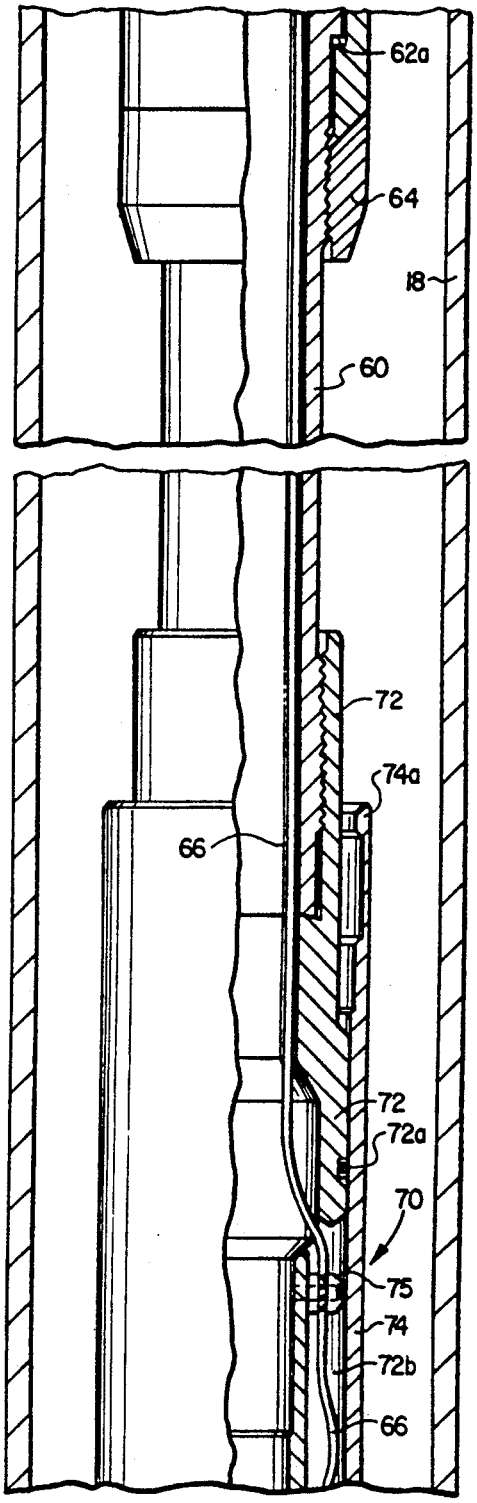

Referring to FIGS. 2B and 2C, the indexing union assembly 32 is connected, via the sleeve 60, to a safety valve assembly, shown in general by the reference numeral 70. To this end, the lower portion of the sleeve 60 is in threaded engagement with an upper sub 72 of the safety valve assembly 70. The safety valve assembly 70 also includes a housing sleeve 74 the upper portion of which extends over the sub 72 and includes a fishing neck 74*a* at its upper end portion. There is no mechanical connection between the sub 72 and the sleeve 74, and a sealing member 72*a* extends in an annular groove formed in the outer surface of the sub 72 which engages the inner surface of the sleeve 74 to permit slidable movement between the sub 72 and the sleeve 74 under conditions to be described.

A portion of the wall of the sub 72 is milled out to define an area 72*b* which receives the fitting 68 (FIG. 2C) and the end of the control line 66. The fitting 68 is externally threaded and extends in an internally threaded bore 72*c* in the sub 72 adjacent the milled area 72. One or more strain relief members 75 (FIG. 2B) are supported by the sub 72 and extend in the area 72*b* for supporting the control line 66.

A tubular control housing 76 (FIG. 2C) extends downwardly from the sub 72 and the housing sleeve 74 with the lower end portion of the sleeve 74 and the upper end portion of the housing 76 in threaded engagement. A fluid flow passage 76*b* extends through the housing 76 and registers with a milled bore 72*d* in the sub 72 which communicates with the threaded bore 72*c* in the sub 72 to receive fluid from the control line 66, via the fitting 68, as will be further described.

A connector assembly, referred to in general by the reference numeral 80 in FIG. 2C, is provided for quick-releasably disconnecting the sub 72 and therefore the fitting 68 and the control line 66, from the remaining components of the safety valve assembly 70. The connector assembly 80 includes a tubular prop 86 extending within the sub 72 and having an outer diameter slightly less than the inner diameter of a corresponding portion of sub 72. The bore of the prop 86 connects the bore of the sub 72 to the bore of the housing 76 to define a continuous flow passage for production fluid, as will be described.

Although not shown in the drawings, it is understood that four radially-extending openings are formed through the sub 72 and are spaced at 90 degree intervals. Two of the openings, which are spaced 180 degrees, respectively receive shear pins, one of which is shown by the reference numeral 88 in FIG. 2C, which extend into an appropriate groove, or notch in the prop 86 to normally secure the prop against axial movement relative to the sub 72. The other two above-mentioned openings function to equalize fluid pressure across the sub 72, as will be described. The above-mentioned openings extend between two axially-spaced seal rings 90*a* and 90*b* disposed in external grooves in the prop 86. The external surface of the prop 86 is configured to define, with the internal surface of the sub 72, two axially-spaced notches, or grooves, 86*a* and 86*b*. A radially-extending weep opening 86*c* extends through the prop 86 and registers with the groove 86*a* for reasons to be described.

A plurality of angularly-spaced retaining lugs 92, one of which is shown in FIG. 2C, extend through corresponding openings in the sub 72. One end of each lug 92 extends flush with the bore of the sub 72 and is maintained in this position by engagement with the outer surface of the prop 86. The other end portion of each lug 92 projects outwardly from its opening where it is engaged by an internal shoulder defined by an internal flange, or fishneck, 76c of the housing 76 to prevent axial upward movement of the sub 72 relative to the housing 76. A retaining ring 94 is disposed in an annular groove formed in the external surface of the prop 86 and extends in a milled groove formed in the inner surface of the sleeve 84 for reasons to be explained.

Figure 4:
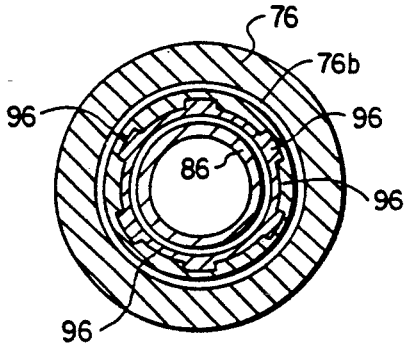

As better shown in FIG. 4, a portion of the internal surface of the housing 76 and a corresponding portion of the external surface of the sub 72 are provided with a plurality of cooperating angularly-spaced grooves and lands, referred to in general by the reference numeral 96 In the connected position shown the lands 96 of the sub 72 engage the grooves 96 of the housing 76 and vice versa. Thus, any torque applied to the housing 76 is transferred to the sub 72, and vice versa.

In the event it is desired to disconnect the sub 72, and therefore the line 66 and the fitting 68 from the safety valve assembly 70, a ball (not shown) of a diameter slightly less than the inner bore of the sub 72 but slightly greater than the inner diameter of the prop 86 is pumped through the reeled tubing 24 and thus passes through the aligned bores of the indexing union assembly 32 and the sleeve 60 and into the upper end portion of the sub 72 where it engages the corresponding end of the prop 86. This seals off the prop 86, allows fluid pressure to build up above the ball and forces it and the prop 86 in a downwardly direction relative to the sub 72 as viewed in FIG. 2C until the pins 88 shear. The prop 86 then moves downwardly relative to the sub 72 and the housing 76 until the groove 86b aligns with the lugs 92 which allows the lugs to move into the groove. Since during this movement the seal ring 90a moves past the above-mentioned openings in the sub 72 that do not receive a shear pin, the latter openings allow any fluid pressure within the bore of the safety valve assembly to equalize with the fluid pressure externally of the assembly, which gives the reeled tubing operator an indication that the connector assembly 80 has been activated.

The lugs 92 are thus released from the inner flange 76c of the housing 76 and, upon an upwardly-directed force being applied to the reeled tubing 24 and therefore the sub 72 via the components connected therebetween, the sub and therefore the line 66 and the fitting 68, will move in an upward direction away from the housing 76. During this operation the weep opening 86c permits any fluid trapped in the groove 86a to pass into the bore of the prop 86. The retaining ring 94 limits the above-mentioned upward movement of the prop 86 relative to the sub 72, thus preventing the lugs 92 from falling out of their respective openings in the sub 72. The two above-mentioned openings in the sub 72 that do not receive a shear pin 88 allow some fluid circulation to occur while the sub 72, the prop 86, and the fitting 68 are pulled out of the well 14. The fishing neck 74a at the upper end of the housing sleeve 74 enables the safety valve assembly 70 to be retrieved with a conventional workstring after the reeled tubing 24 has been removed from the well tubing 18. Further details of the structure and operation of the connector assembly 80 and its associated components are disclosed and described in U.S. Pat. No. 5,146,984 assigned to the same assignee as the present invention, the disclosure of which is hereby incorporated by reference.

Figure 2D:
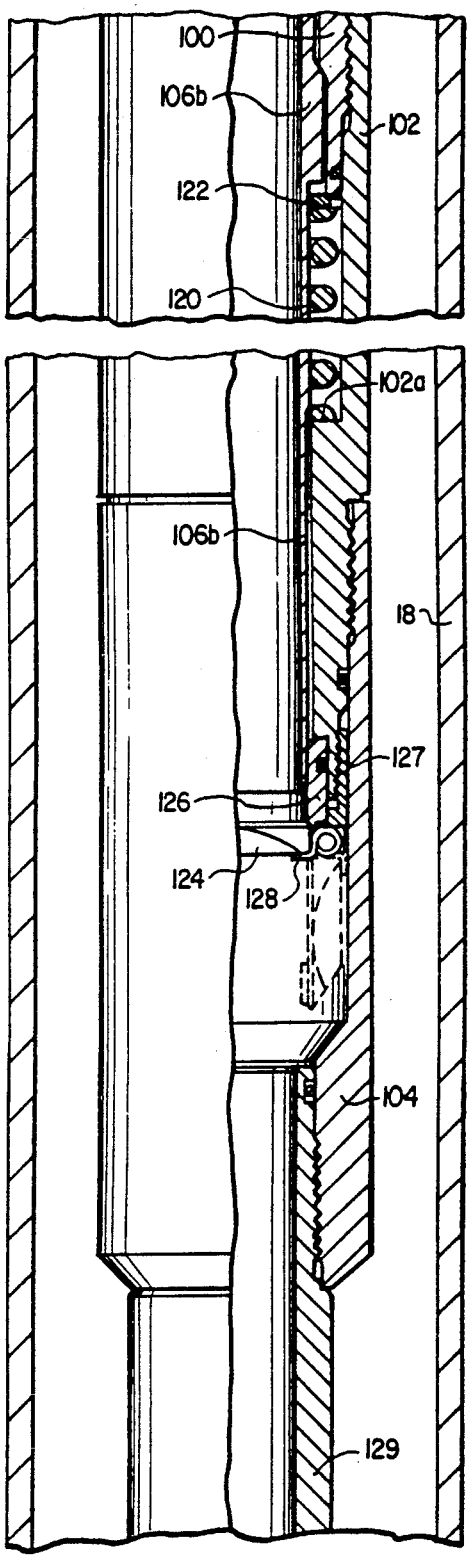

Referring to FIGS. 2C and 2D, the safety valve assembly 70 also includes a packing sub 96 extending within a portion of the housing 76, with its outer surface in a slightly spaced relation to the corresponding inner surface of the housing 76 to define a flow passage 96a registering with the flow passage 76b of the housing 76. A connector sleeve 100 extends just below the lower end of the packing sub 96 and has two externally threaded end portions which are respectively connected to an internally threaded lower end portion of the housing 76 and to an internally threaded upper end portion of a tubular spring housing 102 which is in threaded connection with a lower sub 104. All of these components are in axial alignment and together define a continuous bore for passing production fluid in a manner to be described.

A tubular piston 106 having an outer diameter slightly less than the bores of the packing sub 96, the connector sleeve 100 and the spring housing 102 is disposed in the latter bores for movement relative thereto. The piston 106 consists of an upper portion 106a in threaded engagement with a lower portion 106b, and an annular moving seal member 108 disposed between their adjacent ends. An annular static seal member 110 extends between the outer surface of the packing sub 96 and the inner surface of the upper piston portion 106a. A port 112 is defined between the adjacent ends of the packing sub 96 and the connector sleeve 100 and registers with the flow passage 96a, and a flow passage 114 is defined between the outer surface of the upper piston portion 106a and the inner surface of the connector sleeve 100. Since the flow passage 96a also registers with the flow passage 76b of the housing 76, fluid from the control line 66 and the fitting 68 can flow to the port 112 and the flow passage 114 for activating the piston 106, as will be described.

Referring to FIG. 2D, the spring housing 102 has a stepped internal surface to define a shoulder 102a and a compression spring 120 is located in the annular space defined by the spring housing 102, the shoulder 102a, the lower piston portion 106b and a retaining ring 122 secured to the latter piston portion. The spring 120 thus biases the piston 106 upwardly as viewed in FIG. 2D.

A flapper valve 124 is pivotally mounted between a valve seat member 126 and a retainer member 127 for movement between a closed, horizontal position shown by the solid lines in FIG. 2 in which it blocks the bore of the safety valve assembly 70 and an open, vertical position as shown by the dashed lines. A leaf spring 128 engages the flapper valve 124 and normally urges it to its closed, horizontal position.

Therefore, upon introduction of fluid from the control line 66 and the fitting 68 into the flow passage 76b of the housing 76, the fluid flows into and through the flow passages 76b and 96a and into the port 112. The static seal 110 prevents upward flow of the fluid between the packing sub 96 and the piston 106, and the fluid thus flows from the port 112 through the flow passage 114 and acts against the moving seal member 108. The exposed annular surface of the seal member 108 is greater than that of the exposed annular surface of the seal member 110 so that the fluid pressure acting against the seal member 108 forces it, and therefore the piston 106 downwardly. During this movement, the lower end of the piston portion 106b engages the flapper valve 124 and forces it into its open, vertical position shown by the dashed lines in FIG. 2D. When fluid flow through the control line 66 is terminated the spring 128 forces the valve 124 back to its closed, horizontal position. Thus the safety valve assembly 70 functions to selectively control the flow of production fluid to the bores of the indexing union assembly 32 and the connector 30 and is used primarily to terminate flow during emergency conditions.

Figure 2E:
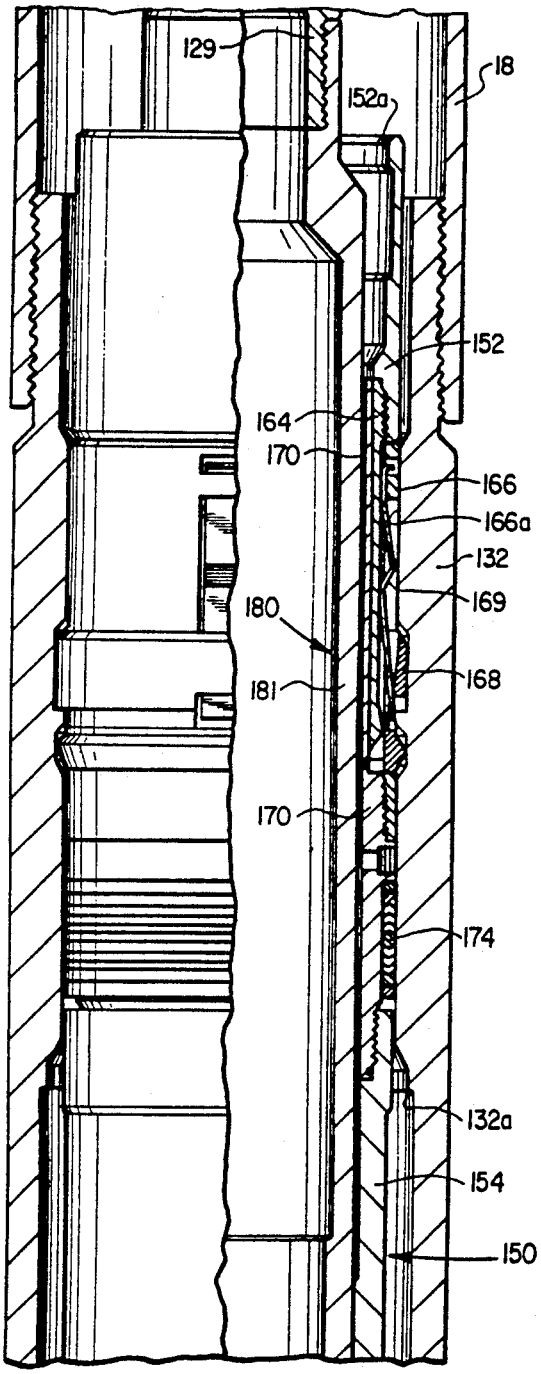

Referring to FIGS. 2D–2E, the safety valve assembly 70 includes a connector sleeve 129 having an upper end portion in threaded engagement with the lower end portion of the lower sub 104. The lower end portion of the sleeve 129 is connected, in a manner to be described, to the sliding sleeve valve assembly 20 previously generally shown and described in connection with FIG. 1, and shown in detail in FIGS. 2E–2G. The assembly 20 includes an upper tubular housing 132 and a lower tubular housing 134 (FIG. 2F) each of which has a stepped outer diameter and inner diameter. An intermediate tubular housing 136 extends between the upper housing 132 and the lower housing 134. The upper and lower end portions of the upper housing 132 are stepped and the upper end portion is in threaded engagement with an upper section (FIG. 2E) of the string of well tubing 18. The lower end portion of the upper housing 132 is in the threaded engagement with an overlapping threaded upper end portion of the intermediate housing 136. Similarly, the lower end portion of the intermediate housing 136 is in threaded engagement with the upper end portion of the lower housing 134 and the lower end portion of the latter housing is internally threaded engagement with a lower section (FIG. 2G) of the string of well tubing 18.

An annular packing 140 (FIG. 2F) extends between the lower end of the upper housing 132 and an inwardly-directed annular flange **136*a* formed on the intermediate housing 136. Similarly, an annular packing 142 extends between the upper end of the lower housing 134 and another inwardly-directed annular flange 136*b* formed on the intermediate housing 136 in a spaced relation to the flange 136*a*. A plurality of angularly-spaced inlet openings 136*c* (one of which is shown) are provided through the intermediate housing 136 and extend between the packings 140 and 142. The assembly 20 is located in the string of well tubing and relative to the casing 10 so that the openings 136*c* are axially aligned with the perforations 10*a* in the casing 10 (FIG. 1**).

The inner bores of the upper housing 132 and the lower housing 134 are stepped to define a pair of shoulders **132*a* (FIG. 2E) and 134*a* (FIG. 2G), respectively, and a continuous enlarged bore extending therebetween. The latter bore receives a sliding sleeve 144, the outer diameter of which is slightly less than the inner diameter of the enlarged bore and the packings 140 and 142. The sleeve 144 is adapted for slidable movement between an open position shown in FIG. 2F in which the lower end of the sleeve 144 engages the shoulder 134*a* and a closed position to be described in which the upper end of the sleeve engages the shoulder 132*a***.

Three axially-spaced annular detents **134*b*, 134*c* and 134*d* are provided in the inner surface of the lower housing and are adapted to be engaged by an annular raised portion 144*a* formed on the outer surface of the sleeve 144. In the open portion of the sleeve 144 shown in FIG. 2G the raised portion 144*a* extends in the detent 134*d***.

Figure 2F:
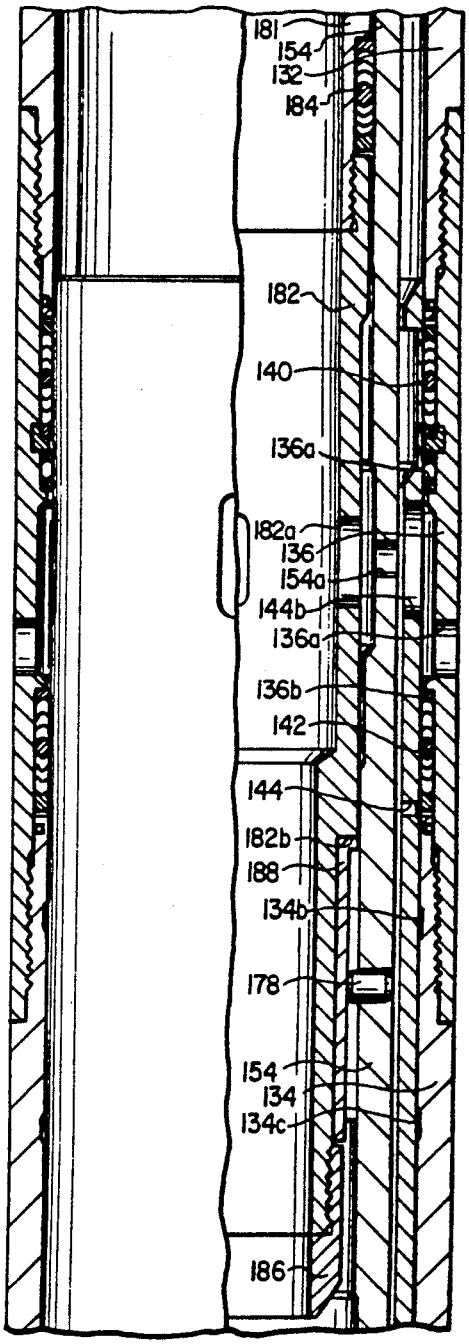

A plurality of angularly-spaced openings **144*b* (one of which is shown) are provided through the sleeve 144 which, in the open position of FIG. 2F, align with the openings 136*c* in the intermediate housing 136. Similarly, a plurality of angularly-spaced, relatively small-diameter passages 144*c* are provided through the sleeve 144** for reasons to be described.

A tubular straddle-isolation assembly 150 is disposed in the bore of the sliding sleeve valve assembly 20 in a coaxial relation thereto. The straddle-isolation assembly 150 includes an upper locking mandrel unit 152 (FIG. 2E), a straddle mandrel 154 (FIGS. 2E and 2F) connected to the lower end of the mandrel unit 152, a packing sub 156 (FIG. 2G) connected to the lower end of the straddle mandrel 154, an equalizer sub 158 (FIG. 2G) connected to the lower end of the packing sub 156 via an adapter 159, and a cap 160 (FIG. 2G) connected to the lower end of the equalizer sub 158. All of these components making up the straddle-isolation assembly 150 are tubular and thus define a continuous bore which is closed at its lower end by the cap 160. Also, all of these components have stepped inner and outer surfaces and their respective end portions are in a telescoping, or overlapping, relationship and are connected together by cooperating internal and external threads respectively provided thereon and seal members extending therebetween. Since these type of connections are conventional they will not be described in any further detail.

Referring to FIGS. 2E and 2F the locking mandrel unit 152 includes a fishing neck **152*a* which enables the locking mandrel unit, with its associated components, to be engaged by a pulling tool (not shown) and pulled from the well 14 under conditions to be described. An expander sleeve 164 is in threaded engagement with a corresponding internal portion of the mandrel unit 152. A portion of the expander sleeve 164 extends within the upper end portion of a locking sleeve 166 having three angularly-spaced elongated openings, or windows, 166*a* (only one of which is shown). Each of the windows 166*a* receives a locking key 168 having a stepped outer surface which, in the locking position shown, extends through its respective window and into corresponding grooves formed in the inner bore of the upper housing 132. Three leaf springs, one of which is shown in FIG. 2E by the reference number 169, are provided between the expander sleeve 164 and the locking sleeve 166. Each leaf spring 169 is bent so that its upper portion extends radially in a slot formed in the locking sleeve 166 and its lower end portion extends underneath a corresponding key 168 to urge the keys radially outwardly into the locking position shown. The expander sleeve 164 can then be moved downwardly to the position shown to lock the keys 168** in their locking position.

A retainer sleeve 170, having a stepped outer surface, receives the expander sleeve 164, the locking sleeve 166 and the keys 168, and is connected, at its lower end portion, to the straddle mandrel 154. Since the locking mandrel unit 152 is conventional and is more specifically described in U.S. Pat. No. 3,208,531, assigned to the same assignee as the present invention, it will not be described in any further detail.

An annular packing 174 extends between a shoulder defined by the stepped outer surface of the sleeve 170 and the upper end of the straddle mandrel 154, and an annular packing 176 (FIG. 2G) extends between a shoulder defined by a stepped outer surface of the packing sub 156 and the upper end of the adapter 159. The packings 174 and 176 are designed to provide a tight fit with their assorted components to withstand and seal against relatively high fluid pressures.

A plurality of angularly-spaced openings **154*a* (one of which is shown in FIG. 2F) are provided through the mandrel 154 which are in axial alignment with the openings 136c in the housing 136 of the assembly 130 and with the openings 144b of the sleeve 144** in the open position of the sleeve shown.

A plurality of angularly-spaced, radially-extending indexing pins 178 (one of which is shown in FIG. 2F) extend through an opening in the straddle mandrel 154 in threaded engagement therewith. The pins 178 project inwardly into the bore of the mandrel 154 and their function will be described later.

Figure 2G:
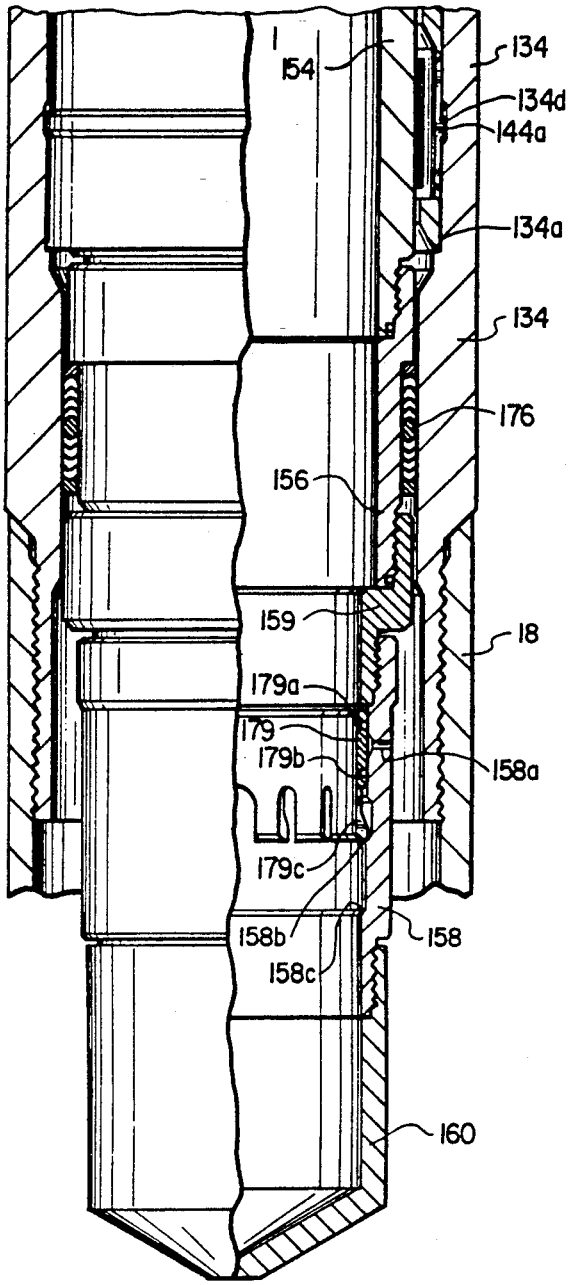

Referring to FIG. 2G, the equalizer sub 158 has a radial passage 158a extending therethrough which is normally blocked by an equalizer valve 179 having two spaced sealing members 179a and 179b engaging the inner bore of the sub and normally straddling the passage 158a. A plurality of slots are formed in the lower end of the valve 179 to form resilient fingers 179c which normally rest on a beveled internal shoulder 158b of the sub 158.

Referring to FIGS. 2E and 2F, the reference numeral 180 refers, in general, to a tubular stinger assembly which extends within the bore of the straddle isolation assembly 150. The upper portion of the stinger assembly 180 includes a packing sub 181 having an internally threaded upper end portion for connection to the lower end portion of the connector sleeve 129.

A circulating sub 182 (FIG. 2F) is connected to the lower end of the packing sub 181 with an annular packing 184 extending between the upper end of the circulating sub 182 and a shoulder formed on the lower end portion of the packing sub 181. A retainer cap 186 extends over the lower end portion of the circulating sub 182. All of these components are tubular, have stepped inner and outer surfaces, and their respective end portions are in a telescoping, or overlapping relationship and are connected together by cooperating internal and external threads respectively provided thereon. Since these types of connections are conventional they will not be described in any further detail.

A plurality of annular-spaced openings 182a (one of which is shown) extend through the circulating sub in axial alignment with the openings 154a of the mandrel 154, with the openings 144b of the sleeve 144 in its open position, and with the openings 136c in the housing 136 of the sliding sleeve valve assembly 20.

An indexing sleeve 188 extends between the upper end of the cap 186 and a shoulder 182b defined by the stepped outer surface of the sub 182. The inner diameter of the sleeve 188 is slightly greater than the outer diameter of the corresponding portion of the sub 182, and the outer diameter of the sleeve 188 is slightly spaced from the corresponding portion of inner diameter of the mandrel 154 to permit rotation of the sleeve 188 for reasons to be described.

Figure 5:
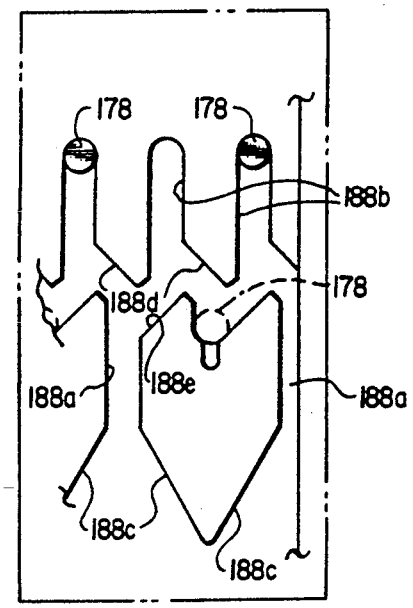
FIG. 5 is a developed view of the indexing sleeve of the control assembly of the present invention.

As shown in FIG. 5, a plurality of slots 188a are provided in the lower portion of the sleeve 188, which receive the indexing pins 178 and a plurality of slots 188b are provided in the upper portion of the sleeve 188. The sleeve 188 also includes angled cam surfaces 188c and 188d located below the slots 188a and 188b, respectively, and angled cam surface 188e located above the slots 188a for reasons to be described. During downward movement of the sleeve 188 relative to the pins 178, the pins engage the lower cam surfaces 188c, work their way into the grooves 188a (by rotation of the sleeve 188 as necessary), engage the upper cam surfaces 188d and work their way into, and pass through, the grooves 188b until they bottom out at the ends of the latter grooves. Upon subsequent upward movement of the sleeve 188 relative to the pin 178, the latter pins pass back through the grooves 188b, engage the cam surface 188e to cause rotation and orientation of the sleeve 188, and bottom out on the lower ends of the latter grooves, as shown by the dashed lines. This restricts the sleeve 188, and therefore the stinger assembly 180, against further upward axial movement relative to the straddle-isolation assembly 150. Since this technique utilizing this pin-groove arrangement is conventional and is disclosed, for example, in U.S. Pat. No. 4,321,965, assigned to the assignee of the present invention, it will not be described in any further detail.

As shown and described above in connection with FIG. 1, a packer 22 extends between the outer surfaces of the well tubing string 18 and the inner surface of the casing 10. The packer 22 operates in a conventional manner to anchor and seal the tubing section 18b (FIG. 2G) to the casing 10 to form a sealed annular chamber and isolate the perforations 10a in the casing 10 from other axially-spaced perforations (not shown) formed through the casing and extending below the perforations 10a. In this manner, the fluid production operation to be described can be applied to the perforations 10a.

It is understood that the sliding sleeve valve assembly 20 is initially positioned in the casing 10, the straddle-isolation assembly 15 is then positioned in the sliding sleeve valve assembly 20, and the stinger assembly 180 is then positioned to the straddle-isolation assembly 150 in the manner described above. For further details of the various components forming the sliding sleeve valve assembly 20, the straddle-isolation assembly 150 and the stinger assembly 180, reference is made to U.S. Pat. No. 5,012,871 assigned to the assignee of the present invention, the disclosure of which is incorporated by reference.

In operation, the sliding sleeve valve assembly 20 is connected between the two well tubing sections 18a and 18b and the assembly is positioned in the wellbore casing 10, as shown in FIG. 1, i.e., with the openings 136c of the housing 136 in approximate axial alignment with the perforations 10a in the casing 10. It is understood that the sleeve 144 of the valve assembly 20 is initially placed in its closed position, with its raised portion 144a in the detent 134b of the housing 134, and the openings 144b axially-spaced from the openings 136b in the intermediate housing 136.

A shifting tool, or the like (not shown), is then inserted into the casing 1 and is lowered until it extends within the sleeve 144. An example of such a shifting tool is disclosed in U.S. Pat. No. 3,051,243, the disclosure of which is incorporated by reference. The shifting tool is adapted to engage the sleeve 144 in a conventional manner and the tool is then moved downwardly to slide the sleeve 144 downwardly. This downward movement of the sleeve 144 continues until the raised portion 144a engages in the detent 134d and the lower end of the sleeve 144 abutts the shoulder 134a of the housing 134 as shown in FIG. 2G. In this position, the openings 144b of the sleeve 144 are in axial alignment with the openings 136c of the intermediate housing 136.

The straddle-isolation assembly 150 is then connected, above surface, to a suitable running tool, or the like (not shown), the upper end of which is connected to a section of reeled tubing (which may be the reeled tubing 24) and the lower end of which is adapted to be quick releasably connected to the fishing neck 152a. The running tool can be of the type disclosed in U.S.

Pat. No. 4,986,362, and assigned to the assignee of the present invention, the disclosure of which is incorporated by reference. The running tool, and therefore the straddle-isolation assembly 150, are then inserted into the casing 10 a disclosed in the above-identified application. A prong (not shown) associated with the running tool initially enters the straddle-isolation assembly 150 and passes through the bore thereof until it engages the upper end of the equalizer valve 179 and forces it downwardly, which causes the shoulder 158*b* formed on the equalizer sub 158 to cam the fingers 179*c* radially inwardly to permit the valve to continue to move downwardly until the lower ends of the fingers engage an internal shoulder 158*c* of the sub 158. This slidable movement of the valve 179 exposes the opening 158*a*, and thus permits any well fluid in the annular chamber between the casing 10 and the tubing string 18 to flow through the latter opening into the interior of the equalizer sub 158 and pass upwardly through the bore of the straddle-isolation assembly 150. This fluid can then exit through suitable radial openings (not shown) formed in the fishing neck 152 in order to equalize the pressure across the straddle-isolation assembly 150 during its downward movement.

The straddle-isolation assembly 150 then inserted into the inner bore of the valve assembly 20 and is lowered until it attains the approximate position shown in FIGS. 2E–2G. During this movement, the keys 168 are initially spring biased into the corresponding groove in the upper housing 132 of the valve assembly 20. Upon further movement of the fishing neck 152 and the expander sleeve 164 downwardly, the latter sleeve locks the keys 168 in the position shown and prevents further downward movement of the latter neck and sleeve. In this position, the openings 154*a* in the mandrel 154 are in alignment with the openings 144*b* and 132*c* respectively provided in the sleeve 144 and the housing 132, which openings extend between the packing assemblies 174 and 176.

The equalizer valve 179 can then be moved back, by the above-mentioned prong, to the position shown in FIG. 2G, i.e. in a position blocking flow through the passage 158*a* and the prong, along with the above-mentioned running tool, are removed from the wellbore.

As shown in FIGS. 2A and 2B, the end portion of the reeled tubing 24 is then connected, via the connector assembly 30, to the indexing union assembly 32 which, in turn, is connected, via the sleeve 60, to the upper sub 72 of the safety valve assembly 70 which, in turn, is connected to the stinger assembly 180. These components are inserted into the tubing string 18 in the casing 10 and lowered until the stinger assembly 180 enters the upper end portion of the straddle-isolation assembly 150 and continues until the pins 178 of the latter assembly pass into and through the appropriate grooves 188*a* in the sleeve 188. Further downward movement of the stinger assembly 180, and therefore the sleeve 188, relative to the pins 178 causes the pins to engage the cam surfaces 188*d* to rotate the sleeve into proper orientation until the pins enter and engage the upper end portions of the grooves 188*b* as shown by the solid lines in FIG. 5, as described above.

The operator then pulls up on the reeled tubing 24 and therefore the stinger assembly 180 and the sleeve 188, which causes the pins 178 to move out of the grooves 188*b* and take the position shown by the dashed lines in FIG. 5, i.e. with the pins engaging the apex of each of the cam surfaces 188*d* to restrict the stinger assembly 180 against further upward axial movement relative to the straddle-isolation assembly 150. In this position of the stinger assembly 180, the openings 182*a* are in alignment with the openings 154*a*, 144*b* and 137*c* as show in FIG. 2F.

Production fluid from the formation 12 (FIG. 1) can then pass, via the perforations 10*a* in the casing 10 into the annular chamber defined between the inner surface of the casing 10, the outer surface of the tubing string 18 and the packer 22. The end cap 60 of the straddle-isolation assembly 150 prevents fluid from entering the lower end portion of the straddle assembly 150. Thus, the fluid passes radially inwardly through the aligned openings 132*c*, 144*b*, 154*a*, and 182 before entering the continuous bore defined by the stinger assembly 180, the safety valve assembly 70, the indexing union assembly 32 and the connector 30. The fluid will then pass to ground surface, via the reeled tubing 24, to external equipment, (not shown) for processing the fluid.

In the event it is necessary to effect an emergency release of the reeled tubing 24 and the control line 66 from the safety valve assembly 70, the above-mentioned ball valve (not shown) is dropped into the reeled tubing 24 and is forced against the end of the prop 86 (FIG. 2C) under the pressure of the fluid from the reeled tubing. The latter pressure thus builds up against the ball valve, and when this pressure is sufficient to exert a force sufficient to shear the pins 88, the prop 86 moves downwardly relative to the sub 72 until the groove 86*b* aligns with the lugs 92. This permits the lugs 92 to move into the groove 86*b*, thus releasing the sub 72 from the housing 76 and permitting a quick disconnect of the sub 72, the fitting 68, and therefore the control line 66, from the remaining components of the safety valve assembly 70. This exposes the fishing neck 74*a* (FIG. 2B) of the housing 74 which allows a heavy duty workstring (not shown), which may include a pulling tool, an accelerator and a hydraulic jar to be lowered into the tubing string 18 until the pulling tool engages the fishing neck 74*a*, permitting a pulling operation to be performed.

It is understood that the above-mentioned holes provided through the sub 72 and not receiving shear pins 88 allow for passage of production fluid for pressure equalization purposes while the sub 72 is being removed from the well.

It is thus seen that the system, assembly and method of the present invention provide an efficient and reliable technique for directing production fluid into and through reeled tubing to the well surface while effectively preventing fluid leakage or loss of well control. Also, the reeled tubing 24 can be connected in the system in a manner to permit a quick and single release of the reeled tubing at a selected downhole location.

Figure 6A:
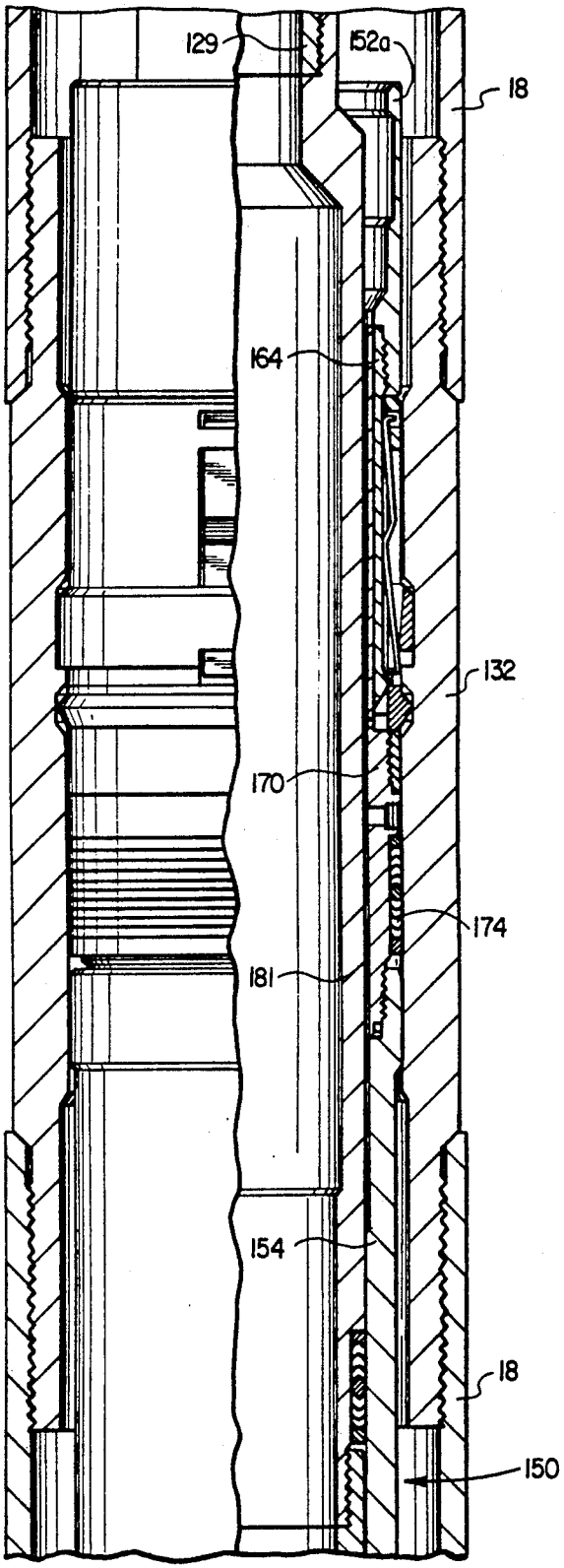
FIGS. 6A and 6B are views similar to FIGS. 2F and 2G, respectively, but depicting an alternate embodiment of the system of the present invention, with FIG. 6B being a downward continuation of FIG. 6A.
Figure 6B:
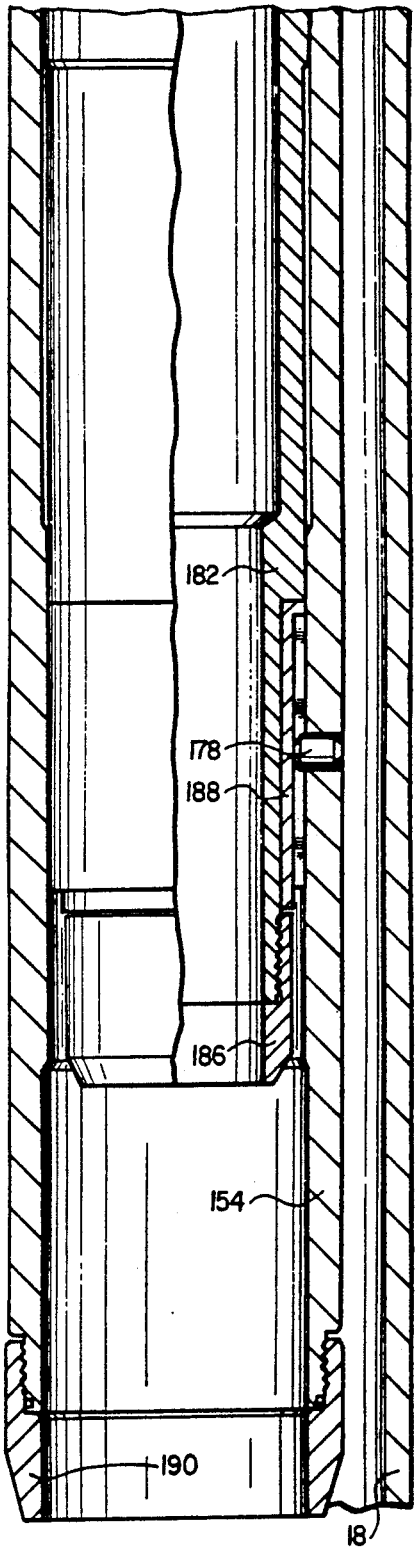

The embodiment of FIGS. 6A and 6B is similar to that of the embodiment of FIGS. 1–5, and identical components are given the same reference numerals. According to the embodiment of FIGS. 6A and 6B, provision is made for permitting the flow of production fluid from the casing 10 into the lower end of the system of the present invention for passage to the reeled tubing 24. To this end, the sliding sleeve valve assembly 20 is eliminated with the exception of the tubular housing 132 which is connected, at its upper end, to the upper section of the production tubing string 18 as shown in FIG. 6A, and, at its lower end to the lower section of the production tubing string 18. The straddle isolation assembly 150, including the straddle mandrel 154, is disposed within the housing 132 and the adjacent portions of the tubing string 18. According to the embodiment of FIGS. 6A and 6B, the components of the embodiment of FIGS. 1-5 extending below the mandrel 154 are eliminated and an open-ended end sub 190 in threaded engagement with the lower end of the mandrel 154. Thus, fluid from below the system can pass, via the sub 190, axially into the lower end portion of the mandrel 154 for passage upwardly through the system to the reeled tubing 24 as described above. The source of the fluid can be from a formation (not shown) located below the packer 22 (FIG. 1) or from the formation 12 in which case the fluid would pass through properly located perforations in the production tubing string 18. Thus the embodiment of FIGS. 6A and 6B enjoys all the advantages of the embodiment of FIGS. 1-5 yet permits flow of the fluid axially into the system thus eliminating the need for the sliding sleeve valve assembly 20.

It is understood that other variations can be made in the foregoing without departing from the scope of the invention. For example, the control line 66 can be mounted on the exterior of the reeled tubing 24, rather than the interior as described above. Also, the casing 10 (FIG. 1) is not absolutely necessary and situations may occur when the tubing sting 18 is lowered into the well 14 and receives the production fluid directly from the formation 12.

Other modifications, changes and substitutions are intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A completion system for producing fluids from a downhole formation through reeled tubing disposed in a wellbore and extending to the well surface, said system comprising a surface controlled subsurface safety valve located at a downhole location in the wellbore to normally prevent fluid flow through the reeled tubing; a control line extending through the reeled tubing from the well surface to the safety valve to pass control fluid to the safety valve to open the safety valve; and means for releasably connecting the safety valve to the reeled tubing.

2. The system of claim 1 wherein said safety valve comprises a pivotally mounted valve member for urging said valve member to a closed position to prevent the flow of said production fluid through said well, and a piston movable in response to said introduction of said fluid to pivot said valve member to an open position to permit the flow of production fluid through said well.

3. The system of claim 1 wherein said safety valve comprises pressure responsive means for disconnecting said safety valve from said reeled tubing.

4. The system of claim 1 wherein said safety valve further comprises means for preventing rotation between said reeled tubing and said safety valve.

5. A system for recovering production fluid from a formation in an oil or gas well, said system comprising reeled tubing extending from above ground into said well, tubular means disposed in said well in communication with said formation for receiving said production fluid, and means connecting said reeled tubing to said tubular means for allowing said production fluid to flow from said formation, through said tubular means and to said reeled tubing for passage to a location above ground, a first valve assembly disposed in said tubular means for selectively controlling the flow of said production fluid from said formation into said tubular means, and a second valve assembly disposed in said tubular means for normally preventing the flow of said production fluid through said tubular means, said second valve assembly being hydraulically actuatable for permitting the flow of said production fluid through said tubular means.

6. The system of claim 5 wherein said tubular means comprises a tubular housing having a radial opening extending therethrough for receiving said production fluid and wherein said first valve means comprises a sleeve extending within said housing and having a radial opening extending therethrough, said sleeve being slidable relative to said housing between an open position in which said openings align to permit the flow of said production fluid into said tubular means and a closed position for blocking said flow.

7. The system of claim 6 wherein said first valve assembly further comprises straddle means extending within said housing and comprising a mandrel having a radial opening extending therethrough and in alignment with said opening in said housing, axially-spaced sealing means supported on said mandrel and extending between, and in sealing engagement with, the outer surface of said mandrel and the inner surface of said housing with said opening in said mandrel extending between said sealing means.

8. The system of claim 7 wherein said sealing means comprises first and second packing assemblies disposed in an axially-spaced relationship, and wherein said aligned openings extend between said packing assemblies.

9. The system of claim 7 wherein said first valve assembly further comprises a stinger means extending within said straddle means and comprising a tubular sub having a radial opening extending therethrough in alignment with said opening in said mandrel and said housing, and locking means associated with said sub for engaging said mandrel to prevent axial movement between said mandrel and said sub, whereby fluid flow is directed, by said sealing means, through said aligned openings to the bore of said stinger assembly for passage to said reeled tubing.

10. The system of claim 9 wherein said locking means comprises a rotatable sleeve mounted on said sub and defining at least one groove, and a pin connected to said mandrel and extending in said groove.

11. The system of claim 8 wherein said second valve assembly comprises a hydraulically actuatable valve member and a conduit extending from above ground, through said reeled tubing and into said tubular means for introducing actuating fluid for actuating said valve member.

12. The system of claim 11 wherein said second valve assembly further comprises means for preventing rotation between said reeled tubing and said valve member.

13. The system of claim 11 further comprising means for securing said conduit relative to said tubular means.

14. The system of claim 11 further comprising passage means defined in said tubular means for permitting the flow of said actuating fluid to said second valve assembly and means responsive to said latter flow for actuating said valve member.

15. The system of claim 8 further comprising means for introducing actuating fluid to said tubular means, and means disposed in said tubular means and responsive to a predetermined condition of said actuating fluid for disconnecting a portion of said tubular means and said conduit from the remaining portion of said tubular means to permit removal of said first-mentioned portion, said connecting means, said reeled tubing and said conduit from said well.

16. A system for recovering production fluid from a formation in an oil or gas well, said system comprising reeled tubing extending from above ground into said well, tubular means disposed in said well in communication with said formation for receiving said production fluid, and means connecting said reeled tubing to said tubular means for allowing said production fluid to flow from said formation, through said tubular means and to said reeled tubing for passage to a location above ground, hydraulically operated valve means disposed in said tubular means for controlling the flow of said production fluid through said tubular means and to said reeled tubing, a conduit extending through said reeled tubing to said tubular means for introducing actuating fluid to said valve means to actuate same, and means disposed in said tubular means and responsive to the introduction of an additional actuating fluid into said tubular means for disconnecting a portion of said tubular means and said conduit from the remaining portion of said tubular means to permit removal of said first-mentioned portion, said connecting means, said reeled tubing and said conduit from said well.

17. The system of claim 16 wherein said disconnecting means comprises means disposed in said tubular means for defining a shoulder for receiving a ball valve and for moving axially relative to said tubular means in response to a predetermined pressure of said additional actuating fluid acting against said ball valve.

* * * * *